US009498047B2

(12) United States Patent
Uresti et al.

(10) Patent No.: US 9,498,047 B2
(45) Date of Patent: Nov. 22, 2016

(54) APPLICATOR FOR A COSMETIC PRODUCT AND ASSOCIATED APPLICATOR ASSEMBLY

(71) Applicant: Albea Services, Gennevilliers (FR)

(72) Inventors: Osvaldo Uresti, Paris (FR); Anne Rutigliano, Maisons-Laffitte (FR); Mark Edmondson, Courgains (FR)

(73) Assignee: ALBEA SERVICES, Gennevilliers (FR)

( * ) Notice: Subject to any disclaimer, the term of this patent is extended or adjusted under 35 U.S.C. 154(b) by 0 days.

(21) Appl. No.: 14/519,263

(22) Filed: Oct. 21, 2014

(65) Prior Publication Data

US 2015/0110540 A1 Apr. 23, 2015

(30) Foreign Application Priority Data

Oct. 22, 2013 (FR) ..... 13 60272

(51) Int. Cl.

| | |
|---|---|
| ***A45D 40/26*** | (2006.01) |
| ***A45D 40/28*** | (2006.01) |
| ***A46B 3/00*** | (2006.01) |
| ***A46B 9/02*** | (2006.01) |

(52) U.S. Cl.

CPC ..... *A45D 40/265* (2013.01); *A45D 40/28* (2013.01); *A46B 3/005* (2013.01); *A46B 9/021* (2013.01); *A46B 2200/106* (2013.01)

(58) Field of Classification Search

CPC ..... A45D 40/262; A45D 40/265; A45D 40/267; A46B 1/00; A46B 3/005; A46B 5/0012; A46B 9/021; A46B 2200/1053; A46B 2200/106; A46B 9/005; A46B 15/0059

See application file for complete search history.

(56) References Cited

U.S. PATENT DOCUMENTS

| | | | | |
|---|---|---|---|---|
| 6,371,130 | B1 * | 4/2002 | Vasas | A46B 9/021 132/218 |
| D613,071 | S | 4/2010 | Berhault | |
| 2002/0014251 | A1 * | 2/2002 | Gueret | A45D 40/267 132/218 |
| 2006/0002758 | A1 * | 1/2006 | Gueret | A45D 40/265 401/122 |
| 2010/0175708 | A1 | 7/2010 | Kim | |
| 2010/0212097 | A1 | 8/2010 | Jeong et al. | |

FOREIGN PATENT DOCUMENTS

| | | |
|---|---|---|
| JP | 2008119453 | 5/2008 |

OTHER PUBLICATIONS

French Application 1360272, Search Report, dated Jun. 18, 2014.

* cited by examiner

*Primary Examiner* — Jennifer C Chiang
*Assistant Examiner* — Bradley Oliver
(74) *Attorney, Agent, or Firm* — Banner & Witcoff, Ltd.

(57) ABSTRACT

The invention relates to an applicator for a cosmetic product, comprising a core having a first end, referred to as a proximal end, and a second, free end, referred to as a distal end, a plurality of protrusions projecting from the core, and a plurality of plates also projecting from the core, wherein the protrusions and the plates are moulded with the core, the core is curved in its direction of extension so as to define a concave part and a convex part, and wherein the protrusions extend substantially over the concave part of the core and the plates extend substantially over the convex part of the core. The invention also relates to an associated applicator assembly.

17 Claims, 3 Drawing Sheets

APPLICATOR FOR A COSMETIC PRODUCT AND ASSOCIATED APPLICATOR ASSEMBLY

Figure 2:
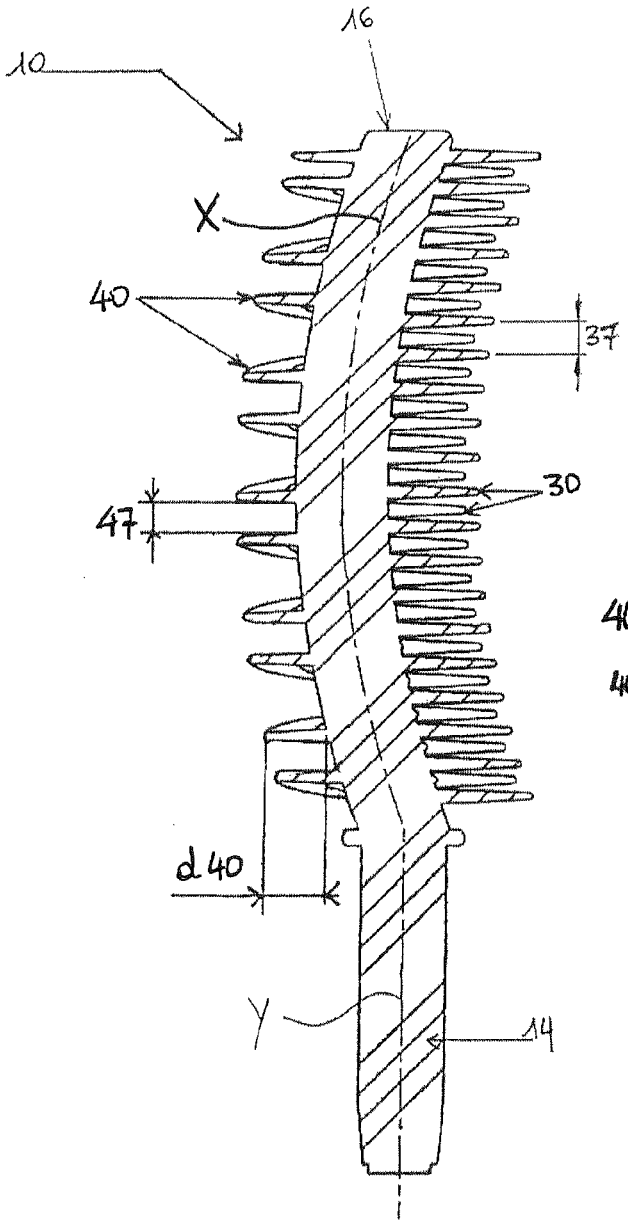

The present application claims priority to, and the benefit of, French Patent Application 1360272 filed Oct. 22, 2013, which is incorporated by reference herein in its entirety.

The invention relates to a cosmetic product applicator and to an associated applicator assembly.

Applicator assemblies for cosmetic products, in particular for cosmetic products to be applied to the eyelashes, such as mascara, comprising a receptacle containing the cosmetic product and an applicator capable of being removably attached to the receptacle, are known.

The receptacle generally comprises a body, the body having walls which delimit a container which contains the cosmetic product, and a neck defining an opening through which the cosmetic product can be removed.

The applicator assembly generally comprises a cap suitable for being attached to the neck, a rod extending from the cap and an applicator attached to a free end of the rod. The applicator comprises a core and a plurality of protrusions or bristles extending from the core.

When the cap is attached to the neck, the rod and the applicator extend within the container. The applicator is immersed in the cosmetic product contained in the container.

To use the applicator, the user detaches the cap from the neck and removes the applicator from the receptacle.

To prevent the applicator from being overloaded with cosmetic product, the receptacle generally comprises a wiper, attached to the interior of the neck. When the user removes the applicator from the receptacle, the applicator slides within the wiper. The wiper scrapes off excess cosmetic product on the rod and on the applicator.

The wiper thus makes it possible to control the amount of product which is on the applicator and prevents an excessive amount of cosmetic product from being applied to the eyelashes.

The wiper in particular limits the amount of product present on the protrusions. There are two parameters that interact for this purpose, namely the internal diameter of the wiper and the radial extension of the protrusions. The radial extension of a protrusion means the distance between the axis of longitudinal extension of the core and the free end of the protrusion.

Thus, the desired amount of product on the protrusions when leaving the wiper results from the compromise between the internal diameter of the wiper and the radial extension of the protrusions.

Moreover, it is known that the regions having protrusions having a shorter radial extension promote the loading of the applicator, whereas the regions having protrusions having a longer radial extension promote the combing of the eyelashes.

The problem addressed by the present invention is that of allowing the eyelashes to be both combed and loaded with an appropriate amount of cosmetic product.

Therefore, the invention relates to an applicator for a cosmetic product, comprising a core having a first end, referred to as a proximal end, and a second, free end, referred to as a distal end, a plurality of protrusions projecting from the core, and a plurality of plates also projecting from the core.

According to the invention, the protrusions and the plates are moulded with the core, the core is curved in its direction of extension so as to define a concave part and a convex part, said protrusions extend substantially over the concave part of the core and said plates extend substantially over the convex part of the core.

The proposed applicator has the advantage, when it is turned, of successively making it possible to load the eyelashes with cosmetic product and then comb them. Indeed, the use of plates on a convex part of the core allows a large amount of cosmetic product to be retained when the applicator passes through the wiper, the plates being more resistant to bending than the protrusions which extend from the core at points.

This applicator is all the more advantageous since it allows the user to firstly apply a large amount of cosmetic product to their eyelashes before combing them as desired. Since the eyelashes are combed with the part comprising the protrusions, in other words the concave part, the applicator according to the invention advantageously allows the users eyelashes to be volumised by matching the curvature thereof.

According to different embodiments of the invention, which may be taken together or separately:

- the core follows a line of curvature located in a plane,
- the line of curvature is a portion of a circle,
- the plates are angular disc portions,
- the plates are inclined, in the plane containing the line of curvature, relative to a longitudinal axis of extension of a cylindrical coupling extending the core,
- the core comprises a centre and a sheath,
- the centre and the sheath are designed such that the sheath covers the centre,
- the sheath bears the protrusions and the plates,
- the centre is in the extension of a cylindrical coupling,
- the cylindrical coupling is intended to be attached to a support rod,
- the sheath is over-moulded on the centre,
- the protrusions and the plates are integrally formed with said sheath,
- the protrusions are arranged in a plurality of rows following the line of curvature,
- the protrusions in two adjacent rows are axially offset from one another,
- the protrusions project from the core with the same length,
- said rows are radially spaced around the core in accordance with a constant angular distance,
- said angular distance is 30°,
- the protrusions have a semi-circular cross section,
- the protrusions each have a planar surface,
- the protrusions are positioned such that planar surfaces of two adjacent protrusions are oriented in the same direction of rotation,
- the protrusions are tapered from their bases to their free ends,
- the protrusions each extend along a normal to the axis of the cylindrical coupling,
- the protrusions are rectilinear,
- the plurality of plates extend between the proximal end and the distal end of the core,
- the plates project from the core at the same height,
- the core is made of plastics material,
- the protrusions are made of plastics material,
- the plates are made of plastics material,
- the protrusions and the plates are integrally formed with the core,
- the core has a substantially constant cross section from the proximal end to the distal end, the core has a substantially circular cross section, the core is solid, the applicator forms a brush.

The invention also relates to an applicator assembly for a cosmetic product which comprises a receptacle having a body which forms a container intended to contain the cosmetic product, and an applicator as described above that is capable of being attached to the receptacle such that the applicator is housed within the container.

Figure 1:
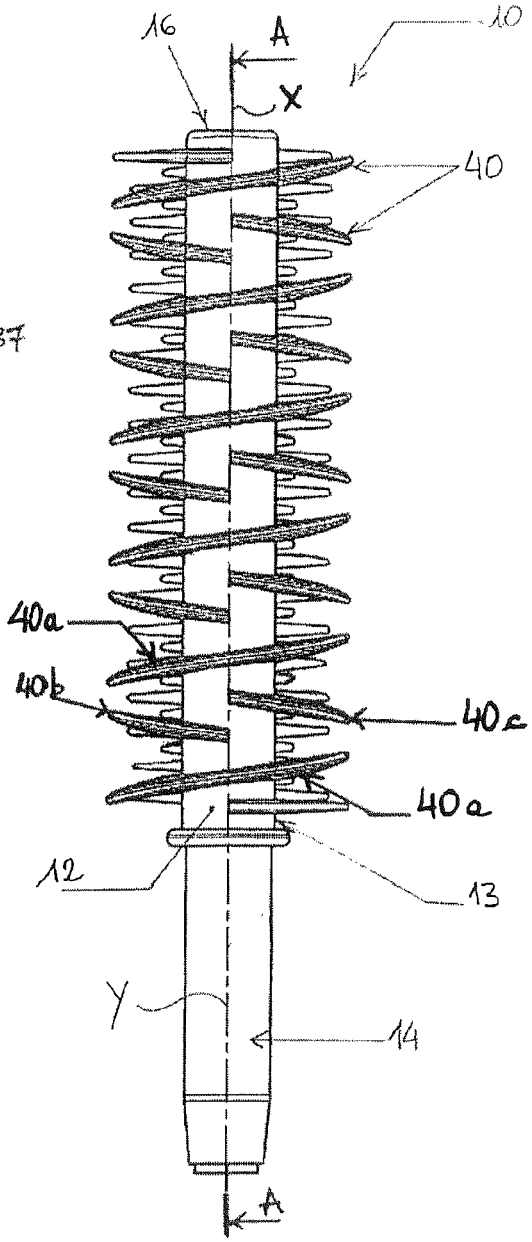
Figure 3:
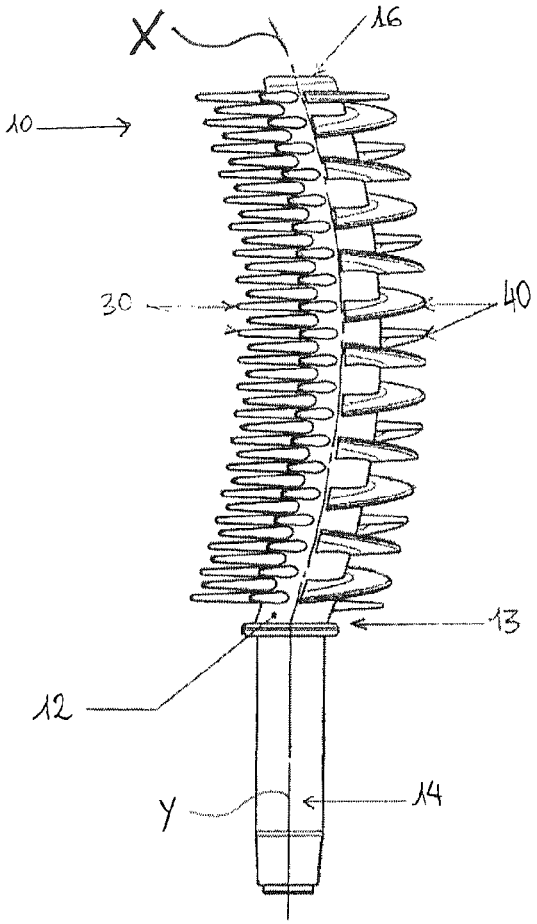
Figure 4:
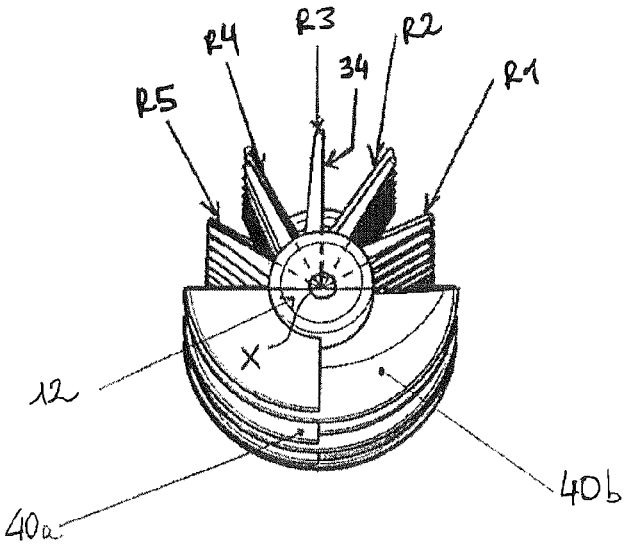
Figure 5:
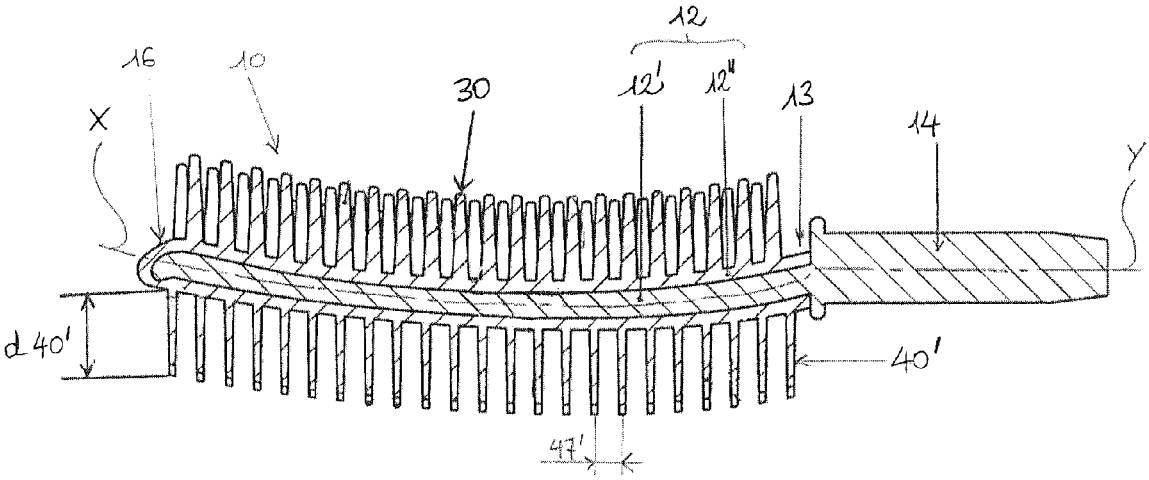
Figure 6:
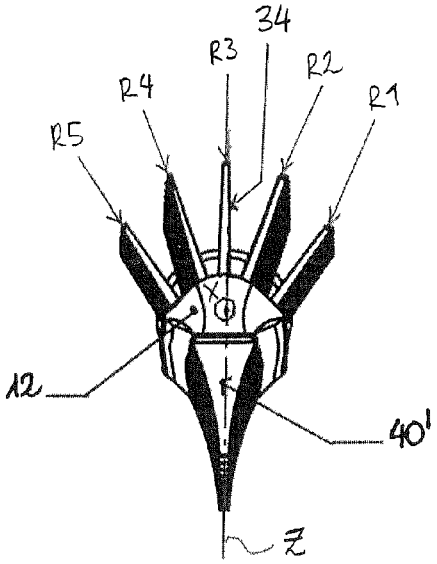

The invention will be better understood and other aims, details, features and advantages thereof will become more apparent upon reading the following detailed explanatory description of at least one embodiment of the invention given purely by way of illustrative and non-limiting example with reference to the accompanying schematic drawings, in which:

FIG. 1 is an elevated view of an embodiment of an applicator according to the invention, FIG. 2 is a cross section along line A-A shown in FIG. 1, FIG. 3 is an elevated view of the applicator from FIG. 1, having undergone a rotation about a longitudinal axis of extension of the core of said applicator by 90° in the anticlockwise direction, FIG. 4 is a plan view of FIG. 1, FIG. 5 is a cross section similar to that in FIG. 2, and it shows an embodiment of the applicator according to the invention which is different from that in FIG. 1, FIG. 6 is a plan view of FIG. 5.

FIG. 1 shows an applicator 10 for a cosmetic product according to the invention. Said applicator 10 comprises a core 12 having a first end, referred to as a proximal end 13, and a second, free end, referred to as a distal end 16, a plurality of protrusions 30 projecting from the core 12, and a plurality of plates 40, 40' also projecting from the core 12. The core 12 is also extended in this case by a cylindrical coupling 14 for attaching the applicator 10, extending from the proximal end 13 of the core 12.

The protrusions 30 and the plates 40, 40' are moulded with the core 12. When the core has a centre 12' and a sheath 12", it is the sheath 12" that bears the protrusions 30 and the plates 40' (see the embodiment shown in FIGS. 5 and 6).

In other words, the protrusions 30 and the plates 40 may be integrally formed with the core 12 or over-moulded on the core 12. Again, in other words, when the core has a centre 12' and a sheath 12", the sheath 12" is over-moulded on the centre 12' and the protrusions 30 and the plates 30' are integrally formed with said sheath 12".

This provides interesting options in terms of the shapes for said protrusions 30 and said plates 40, 40'.

In the example shown in FIGS. 1 to 4, the plates 40 are produced in the form of angular disc portions. Said plates 40 are for example half-discs 40*a* or quarter-discs 40*b*, 40*c* (see FIG. 1). In other words, the plates 40 are disc portions 40*a*, 40*b*, 40*c* which occupy part of the radial periphery of the core 12 and, preferably, said plates 40 occupy either an angular portion of approximately 90° or an angular portion of approximately 180° (see FIG. 4). Advantageously, said discs 40*a*, 40*b*, 40*c* may occupy said angular portion which is in the range of from 60° to 210°.

According to the embodiment shown in FIGS. 5 and 6, the plates 40' are produced in the form of triangles that also occupy part of the radial periphery of the core 12, that is to say an angular portion which is in the range of angles of from 5° to 30°, preferably an angular portion of approximately 10°.

As can be seen in FIGS. 2, 3 and 5, the core 12 is curved in its direction of extension so as to define an concave part and a convex part that both extend between the proximal and distal ends of said core. In this case, the core 12 follows a line of curvature located in a plane; said line of curvature is provided with reference sign X in the drawings.

It is noted that, for the embodiment in FIGS. 1 to 4, said line of curvature X is a portion of a circle or an arc of a circle extending between the proximal end 13 and the distal end 16 of the core 12. The radius of curvature of this arc may be a value between 20 and 40 mm, preferably a value of approximately 30 mm.

According to the invention, the plurality of plates 40, 40' extends substantially over the convex part of the core 12, whereas the plurality of protrusions 30 extends substantially over the concave part of the core 12.

Since the applicant has noted that users reflexively select the concave part of the applicators having curved cores in order to apply make-up, they decided to provide the protrusions 30 which promote a combing effect on this concave part.

The plates 40, 40' that are in the form of discs 40*a*, 40*b*, 40*c* (FIGS. 1 to 4) or triangles 40' (FIGS. 5 and 6) are wiped to a lesser extent than the protrusions 30, since the plates 40, 40' are more resistant to bending. They are therefore loaded with a greater amount of cosmetic product than the protrusions 30. Therefore, in addition to a potential sculpting action, the plates 40, 40' have the advantage of making it possible to load the users eyelashes with product as a result.

In other words, the plates 40, 40' do not perform a combing action; this action is performed by the protrusions 30.

This is the reason why the protrusions 30 are provided on the concave part of the present applicator 10, in order to ensure that the user can, using a natural gesture, comb their eyelashes after having loaded them with product.

Moreover, in the embodiment shown in FIGS. 1 to 4, the plates 40 are inclined in the plane containing the line of curvature X relative to the longitudinal axis of extension of the cylindrical coupling 14, which is provided with reference sign Y in the drawings; said plates belong to planes that are secant to said longitudinal axis of extension Y, said secant planes preferably being non-orthogonal to the axis Y.

The advantage of this is the option of grouping the user's eyelashes together by making them converge while loading them with cosmetic product.

In the embodiment shown in FIGS. 5 and 6, the plates 40' are inclined relative to the longitudinal axis of extension Y of the cylindrical coupling 14 in the plane containing the line of curvature X. Said plates belong to planes that are substantially orthogonal to said longitudinal axis of extension Y.

The advantage of this is the option of defining sections of eyelashes while loading them with cosmetic product.

Furthermore, in the embodiment in FIGS. 1 to 4, the angular portion of the core 12 that comprises said plates 40 is substantially equal to 180°, and the plates 40 therefore only occupy a portion of the radial periphery of the core 12. As mentioned above, the applicator 10 also comprises a plurality of protrusions 30, in particular over the part of the radial periphery of the core 12 that is not occupied by the plates 40. In other words, said plurality of protrusions 30 occupies an angular portion of the core that is substantially equal to 180°, which is different from the angular portion occupied by the plates 40 described above.

Said plates 40 include narrow plates and/or wide plates, such that said narrow plates extend over an angular portion of the core 12 of less than 90° and said wide plates extend over an angular portion of the core 12 of greater than 90°. The narrow plates are positioned on either side of the same plane. The number of narrow plates is greater than the number of wide plates. Such features reduce the effect of ribbing on said core 12 by the plates 40.

In the embodiment shown in FIGS. 5 and 6, the angular portion of the core 12 that comprises said plates 40' is less than 45°, preferably approximately 20°, or equal to 10°. The angular portion of the core 12 that comprises the protrusions 30 is different from the angular portion occupied by the plates 40'; it is less than 120°, preferably approximately 100°, or equal to 90°.

Still within the context of this embodiment, it should be noted that the angular portions of the core 12 that are not occupied by either the plates 40' or the protrusions 30 are empty angular portions.

In addition, the plates 40', which can be seen in particular in FIG. 6, have an axis of symmetry provided with reference sign Z. Said axis of symmetry Z is perpendicular to the longitudinal axis of extension Y of the cylindrical coupling 14 in the plane containing the axis of curvature X. Said plates 40' are narrower in the region of their free end than in the region of their base, said base being positioned in the region of the periphery of the core 12, more specifically of the sheath 12" in the present case. The advantage of this is the penetration of said plates between a user's eyelashes. Said penetration is made easier and the eyelashes are defined more easily in the form of sections.

It is interesting to note that the protrusions 30 occupy, in this embodiment, an angular portion separated into two substantially equal angular parts by this axis of symmetry Z.

In the two embodiments described here, the protrusions 30 project from the core and are arranged in a plurality of rows R1-R5 (see FIGS. 4 and 6). In this case, the rows R1-R5 have the property of extending along the line of curvature of the core X. The radial spacing between said rows R1-R5 around the core 12 is made in accordance with a constant angular distance. Said angular distance is within the range of from 10° to 45°, and it is preferably from 15° to 30°. The embodiments described here have five rows R1-R5. This number of rows varies depending on the selected angular distance between said rows.

It should be noted that the protrusions of two adjacent rows are offset axially from one another. Offset means that the protrusions 30 of one row are axially offset from the protrusions 30 in the adjacent rows, said rows R1-R5 having substantially the same spacing 37 between their protrusions 30 of approximately one millimetre, for example (see FIG. 2). Therefore, over the same axial portion, the rows R1-R5 have the same number of protrusions 30, to within one protrusion 30 more or less, for example twenty protrusions 30.

In the embodiment shown in FIGS. 5 and 6, it should be noted that the rows R1 and R5 may have a number of protrusions that is less than the number of protrusions in rows R2, R3 and R4. Therefore, the part of the applicator 10 that is adjacent to the distal end 16 only has three rows R2-R4 of protrusions 30, whereas the adjacent part of the proximal end 14 itself has five rows R1-R5 of protrusions. The difference between the rows R1, R5 and the rows R2-R4 is from 3 to 6 protrusions.

Furthermore, said protrusions 30 preferably have a semi-circular cross section. The protrusions can thus be positioned so that the planar surfaces 34 of two adjacent protrusions 30 are oriented in the same direction of rotation about the core 12 (see FIGS. 4 and 6). This means that the protrusions 30 in a first row R1 all have a planar face 34 that is oriented radially in a first direction about the core 12, and that the planar faces 34 of the protrusions 30 in rows R2 and R4 adjacent to the row R3, for example, are oriented in the same direction about the core 12. In other words, no planar face 34 is opposite another planar face 34.

The moulding of said protrusions 30 with the core 12 is therefore easy, because it allows the use of sliding mould cores which are simple in shape, all have substantially the same shape, and are all oriented radially in the same direction.

The protrusions 30 are rectilinear and furthermore can be substantially tapered from their base to their free end. In addition, said protrusions 30 each extend along a normal to the axis of the cylindrical coupling 14.

Furthermore, the protrusions 30 are preferably moulded using the same plastics material as the core 12, or integrally formed with the core 12. Therefore, said protrusions 30, like the plates 40, 40' described above, are integrally formed with the core 12.

In this case, the core 12 includes the specific case in which the core 12 has a centre 12' and a sheath 12": this means that the said centre 12' and said sheath 12" are made of the same material. The centre 12' and the sheath 12" may however be made of different materials, said materials having different mechanical or aesthetic properties, for example colour.

For example, the core 12, the protrusions 30 and said plates 40, 40' can be moulded from a material based on LDPE (low-density polyethylene). Other materials may also be used, namely the material "Exact" from ExxonMobil or the material "Hytrel" from Dupont, or a mixture of these materials. Other materials may be used, for example thermoplastic elastomers (TPE), thermoplastic polyurethane (TPU), styrene-butadiene-styrene (SBS) and styrene-ethylene-butylene-styrene (SEBS) copolymers, or polyamide (PA).

Said protrusions 30 are all substantially the same length. In other words, the distance between the radial periphery of the core 12 and the free end of the protrusions 30 is substantially the same for all the protrusions 30 that the applicator 10 comprises. In this way, the protrusions 30 define an envelope following the curvature of the core X. For the same concave shape of the envelope formed by the protrusions, a cosmetic product is thus obtained that is more uniformly loaded on all the protrusions 30 than in the case of a straight core and teeth of different lengths. In this way, the applicator 10 may increase the volumising effect given to the eyelashes by the invention. In fact, the concave shape of the envelope formed by the free ends of said protrusions 30 matches the convex shape of the rows of eyelashes to which cosmetic product is to be applied.

Said plates 40, 40' also project from the core 12 at a height d40, d40' which is substantially the same. Said height d40, d40' may be in the range of from 1.5 to 4 mm, and is preferably equal to 1.85 mm within the context of the embodiment in FIGS. 1 to 4 (see FIG. 2), and preferably equal to 3 mm within the context of the embodiment in FIGS. 5 and 6 (see FIG. 5).

It should be noted that the spacing 47, 47' between each plate 40, 40' must not be too great, so as to prevent excessively large lumps of cosmetic product from being formed on the user's eyelashes. Said spacing 47, 47' also must not be too small, at the risk of the plates 40 no longer having the ability to load the lashes with product. This spacing 47, 47' is approximately one millimetre.

In particular, in the embodiment in FIGS. 1 to 4, the spacing 47 between each half-disc 40*a* and the quarter-disc 40*b* which is adjacent thereto is preferably equal to 0.9 mm.

It should also be noted that the core 12 has a substantially circular cross section, in particular within the context of the embodiment in FIGS. 1 to 4.

Within the context of the two embodiments, the core 12 is provided so as to be solid and to have a substantially constant cross section from its proximal end 13 to its distal end 16. It is also possible, in another embodiment which is not shown, for the core 12 to be hollow.

It should be noted that the applicator 10 advantageously forms a brush.

The invention also relates to an applicator assembly for a cosmetic product, comprising a receptacle having a body which forms a container intended to contain the cosmetic product, and an applicator, as described above, suitable for being attached to the receptacle, so that the applicator is housed inside the container. Said applicator 10 is attached, for example, to the end of a rod, the rod itself being attached to a cap that is advantageously screwed to the receptacle. After assembly, the cylindrical coupling 14 is positioned in the rod and the proximal end 13 of the core forms the visible proximal end of the applicator.

It should also be noted that variants are of course possible. In particular, it is also conceivable, in additional embodiments, for the applicator to have a core having a polygonal cross section.

The embodiments set out above may be combined with one another, without departing from the scope of the invention. Furthermore, said embodiments are not limiting.

The invention claimed is:

1. Applicator for a cosmetic product, comprising:

a core having a first end, referred to as a proximal end, and a second, free end, referred to as a distal end, a plurality of protrusions projecting from the core, and a plurality of plates also projecting from the core, wherein the protrusions and the plates are moulded with the core, the core is curved in its direction of extension so as to define a concave part and a convex part, and wherein said protrusions extend substantially over the concave part of the core and said plates extend substantially over the convex part of the core, said plates include narrow plates and wide plates.

2. Applicator according to claim 1, wherein the core follows a line of curvature (X) located in a plane.

3. Applicator according to claim 2, wherein the line of curvature (X) is a portion of a circle.

4. Applicator according to claim 1, wherein the plates are angular disc portions.

5. Applicator according to any claim 2, wherein the plates are inclined, in the plane containing the line of curvature (X), relative to a longitudinal axis of extension (Y) of a cylindrical coupling extending the core.

6. Applicator according to claim 1, wherein the core comprises a centre and a sheath designed such that the sheath covers the centre, said sheath bearing the protrusions and the plates and said centre being in the extension of a cylindrical coupling.

7. Applicator according to claim 6, wherein the sheath is over-moulded on the centre.

8. Applicator according to claim 6, wherein the protrusions and the plates are integrally formed with the sheath.

9. Applicator according to claim 2, wherein the protrusions are arranged in a plurality of rows (R1-R5) following the line of curvature of the core (X).

10. Applicator according to the claim 9, wherein said rows (R1-R5) are radially spaced around the core in accordance with a constant angular distance.

11. Applicator according to claim 1, wherein the protrusions project from the core with the same length.

12. Applicator according to claim 1, wherein the protrusions each have a planar surface, the protrusions being positioned such that planar surfaces of two adjacent protrusions are oriented in the same direction of rotation.

13. Applicator according to claim 1, wherein the plurality of plates extends between the proximal end and the distal end of the core, said plates projecting from the core at the same height.

14. Applicator assembly for a cosmetic product, comprising:

a receptacle having a body which forms a container intended to contain the cosmetic product, and an applicator according to claim 1 that is configured to be attached to the receptacle such that the applicator is housed within the container.

15. Applicator according to any claim 4, wherein the plates are inclined, in the plane containing the line of curvature (X), relative to a longitudinal axis of extension (Y) of a cylindrical coupling extending the core.

16. Applicator according to claim 2, wherein the core comprises a centre and a sheath designed such that the sheath covers the centre, said sheath bearing the protrusions and the plates and said centre being in the extension of a cylindrical coupling.

17. Applicator according to claim 7, wherein the protrusions and the plates are integrally formed with the sheath.

* * * * *